US006662989B1

(12) United States Patent
Chang et al.

(10) Patent No.: US 6,662,989 B1
(45) Date of Patent: Dec. 16, 2003

(54) DEVICE FOR ADJUSTING SINGLE OR AUTO SHOOTING FOR STAPLE GUNS

(75) Inventors: Li-Hsing Chang, Taichung (TW); Shin-Nan Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/331,440

(22) Filed: Dec. 27, 2002

(51) Int. Cl.[7] ..... B25C 1/04
(52) U.S. Cl. ..... 227/8; 227/130
(58) Field of Search ..... 227/130, 8, 136

(56) References Cited

U.S. PATENT DOCUMENTS 5,551,621 A * 9/1996 Valles ..... 227/130
5,692,663 A * 12/1997 Yang ..... 227/8
5,791,545 A * 8/1998 Lin ..... 227/130
5,836,501 A * 11/1998 Lai ..... 227/8
5,862,969 A * 1/1999 Lee ..... 227/130
6,059,161 A * 5/2000 Chang et al. ..... 227/130
6,116,488 A * 9/2000 Lee ..... 227/8
6,213,372 B1 * 4/2001 Chen ..... 227/8
6,357,647 B1 * 3/2002 Ou ..... 227/8

* cited by examiner

*Primary Examiner*—Scott A. Smith
(74) *Attorney, Agent, or Firm*—Charles E. Baxley

(57) ABSTRACT

A trigger assembly for a staple gun includes a trigger with an activation member received therein and an adjusting member engaged with the trigger. A cam rod rotatable extends through the body of the staple gun, the passage at an end of the trigger and an eccentric hole in the adjusting member. The adjusting member has a lug which can be engaged with two of the positioning notches defined in the body of the staple gun. The activation plate and the trigger can be lowered or lifted by rotating the adjusting member, and this adjustment changes the relative positions between the activation member, the valve of the staple gun and the safety plate so as to have single shooting or auto shooting feature.

1 Claim, 11 Drawing Sheets

DEVICE FOR ADJUSTING SINGLE OR AUTO SHOOTING FOR STAPLE GUNS

FIELD OF THE INVENTION

The present invention relates to a staple gun that has an adjusting member which lifts or lowers an activation plate connected with the trigger so as to perform single or auto shooting feature.

BACKGROUND OF THE INVENTION

A conventional staple gun is shown in FIGS. 1 and 2 and generally includes a body 10 with a valve 13 connected thereto which is activated by an activation plate 12 so as to eject a staple or a nail. The activation plate 12 is located behind the trigger 11 and a safety plate 14 extends through a hole 15 defined through the trigger 11 and contacts the activation plate 12. The activation plate 12 includes a fork-like end and includes two protrusions 17 and a recess 16, located between the two protrusions 17. The safety plate 14 is first pushed against the object to be stapled and the pushes the activation plate 12 toward the valve 13. When the trigger 11 is pulled, the body of the activation plate 12 touches the valve 13 to eject the staple. The push of the trigger 11 makes the activation plate 12 pivoted an angle so that the safety plate 14 no longer contacts the body of the activation plate, 12 and is located between the two protrusions 17. Therefore, the activation plate 12 is not pushed by the safety plate 14 and no staple will be ejected even if the trigger 11 is pulled again. This single shooting feature does not meet the requirement of continuous shootings of the users and repeatedly release and pull the trigger consumes, ;too much time and efforts.

The present invention intends to provide a device that can set the staple gun at single shooting or auto shooting status.

SUMMARY OF THE INVENTION

In accordance with one aspect of the present invention, there is provided a staple gun that has a trigger assembly which comprises a trigger with an activation plate received therein and an adjusting member connected to the trigger. A cam rod extends through the body of the staple gun and is engaged with an eccentric hole defined through the adjusting member such that the trigger and the activation plate are both lifted or lowered by rotating the adjusting member. The relative position between the activation plate, the valve and the safety plate of the staple gun can be adjusted so as to obtain different ways of shooting of the staples.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
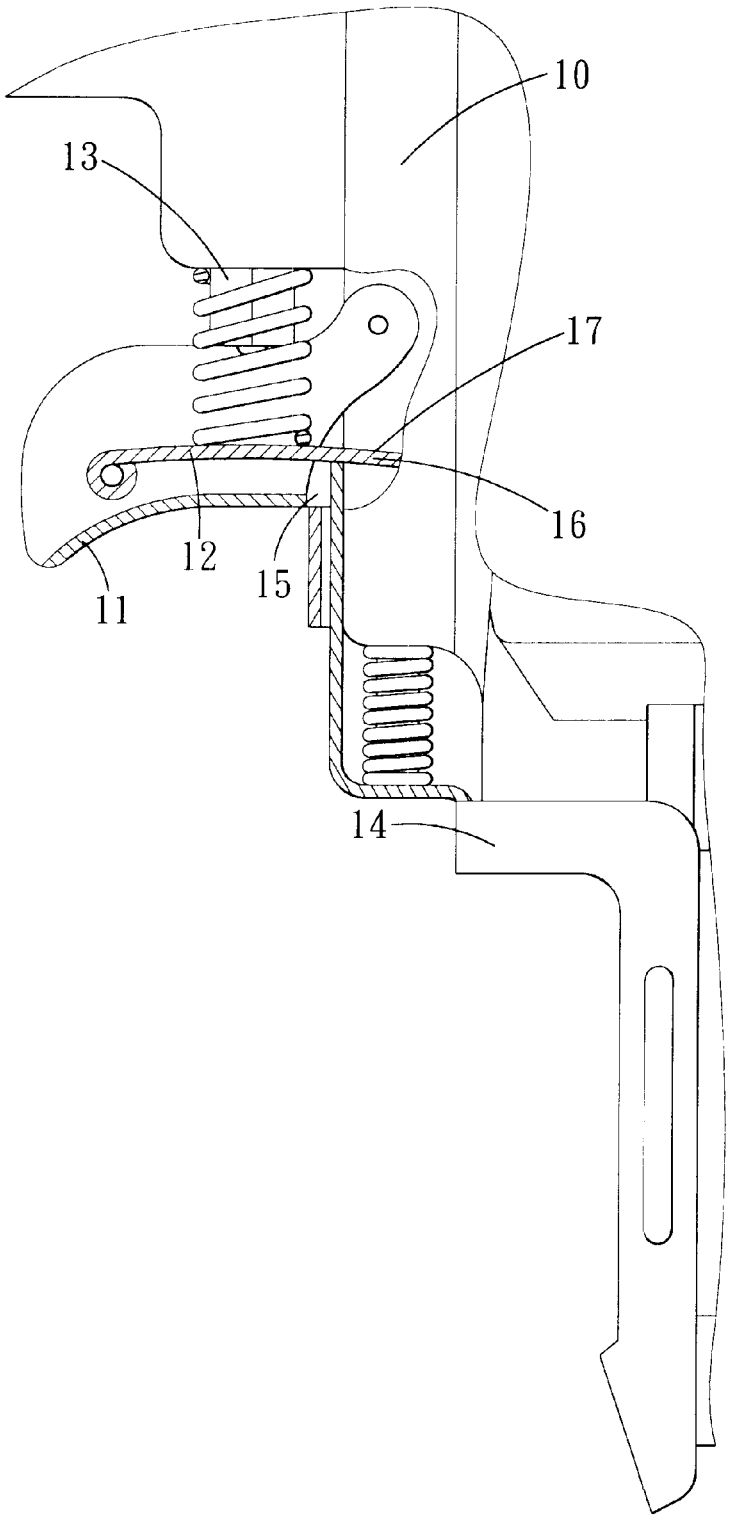
FIG. 1 PRIOR ART
FIG. 1 shows the trigger assembly of a conventional staple gun.
Figure 2:
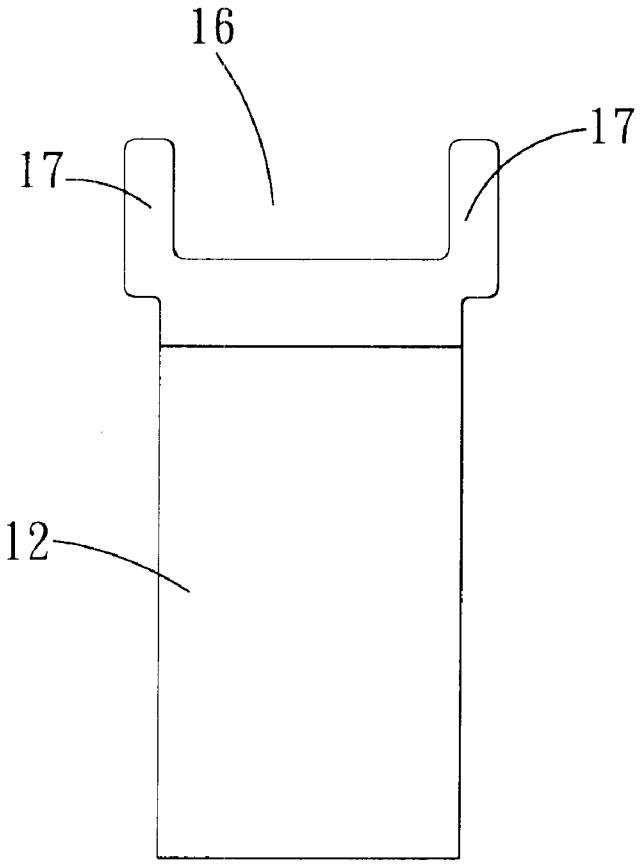
FIG. 2 PRIOR ART
FIG. 2 shows the activation plate of the conventional staple gun.
Figure 3:
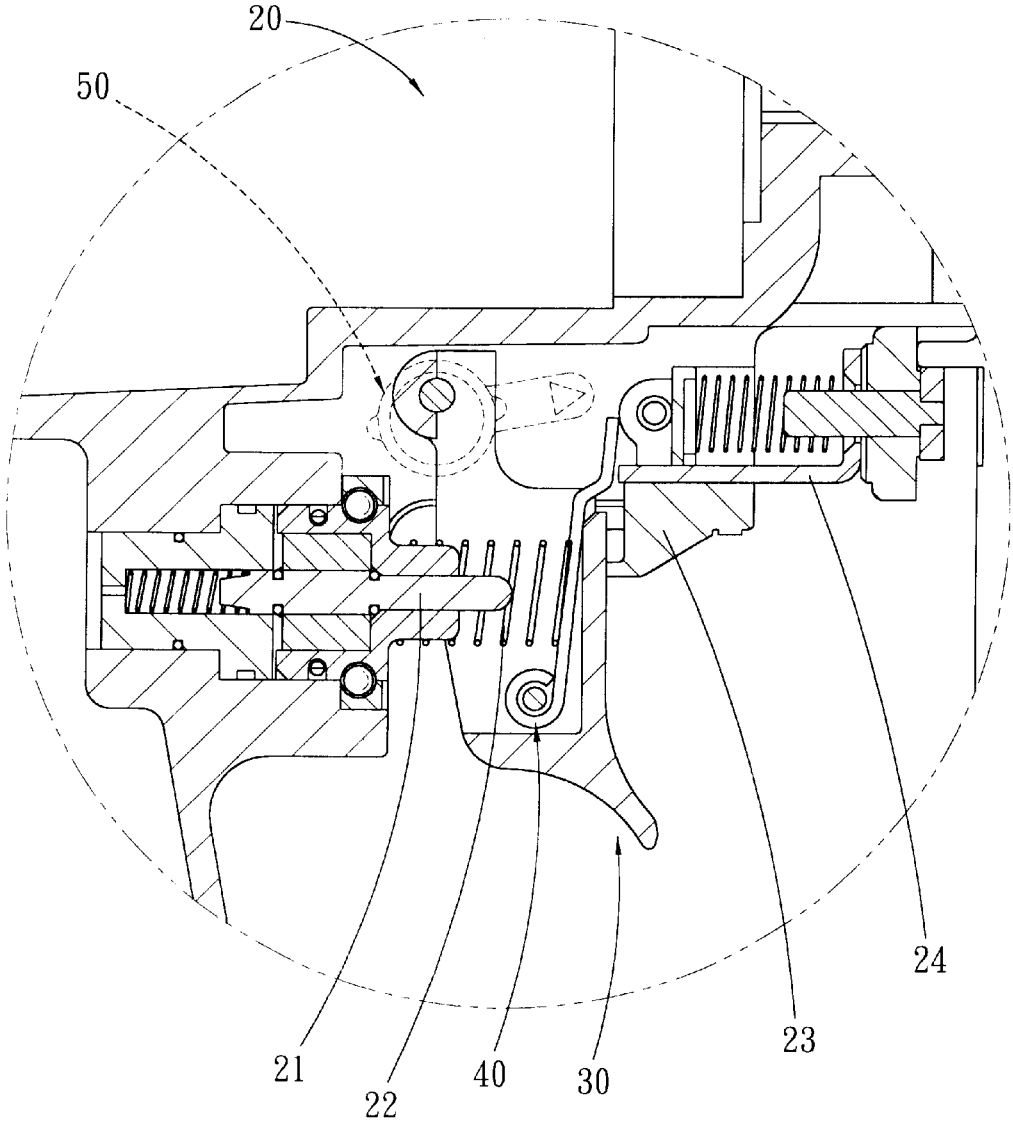
FIG. 3 shows the trigger assembly of the present invention.
Figure 4:
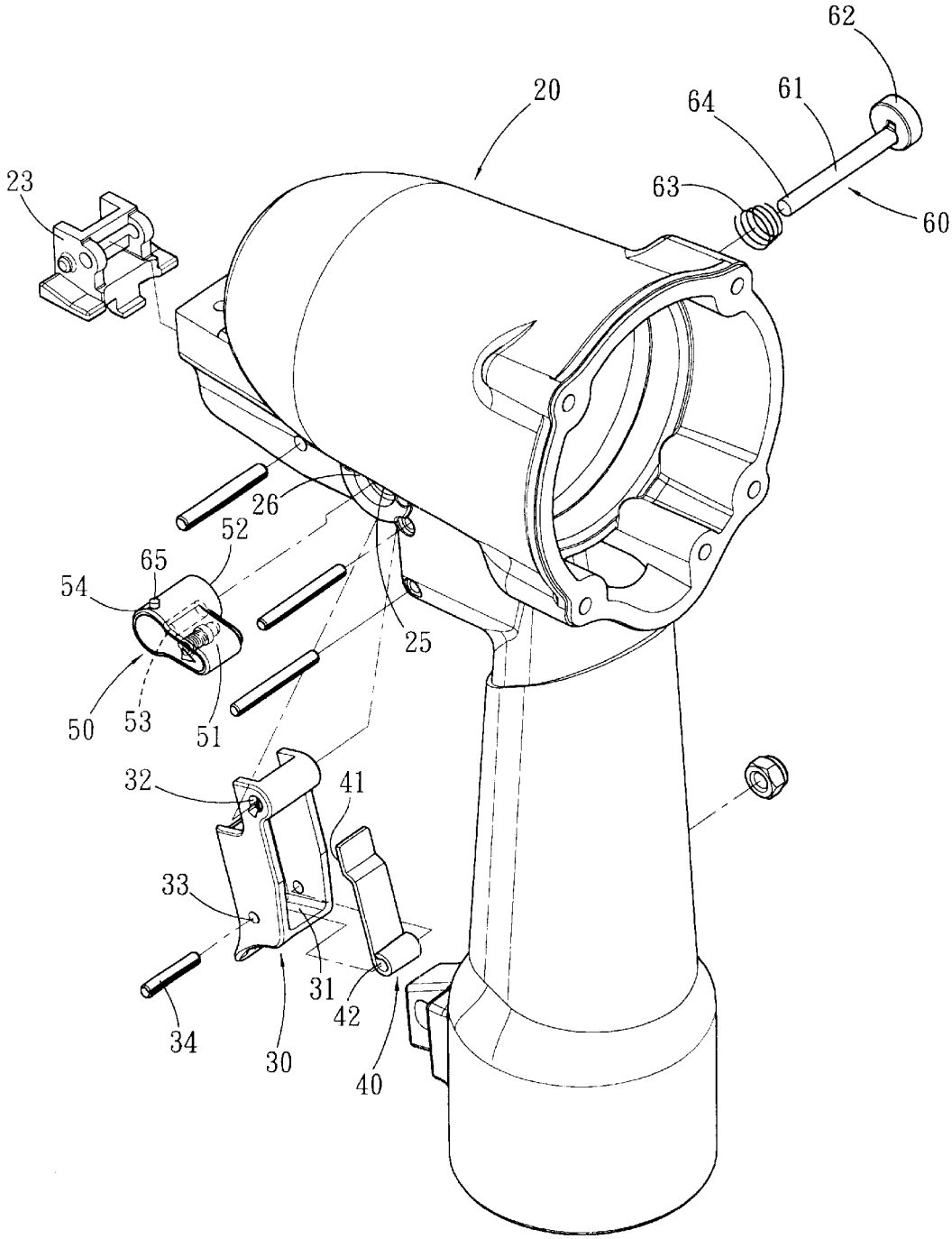
FIG. 4 is an exploded view to show the trigger assembly of the present invention.
Figure 5:
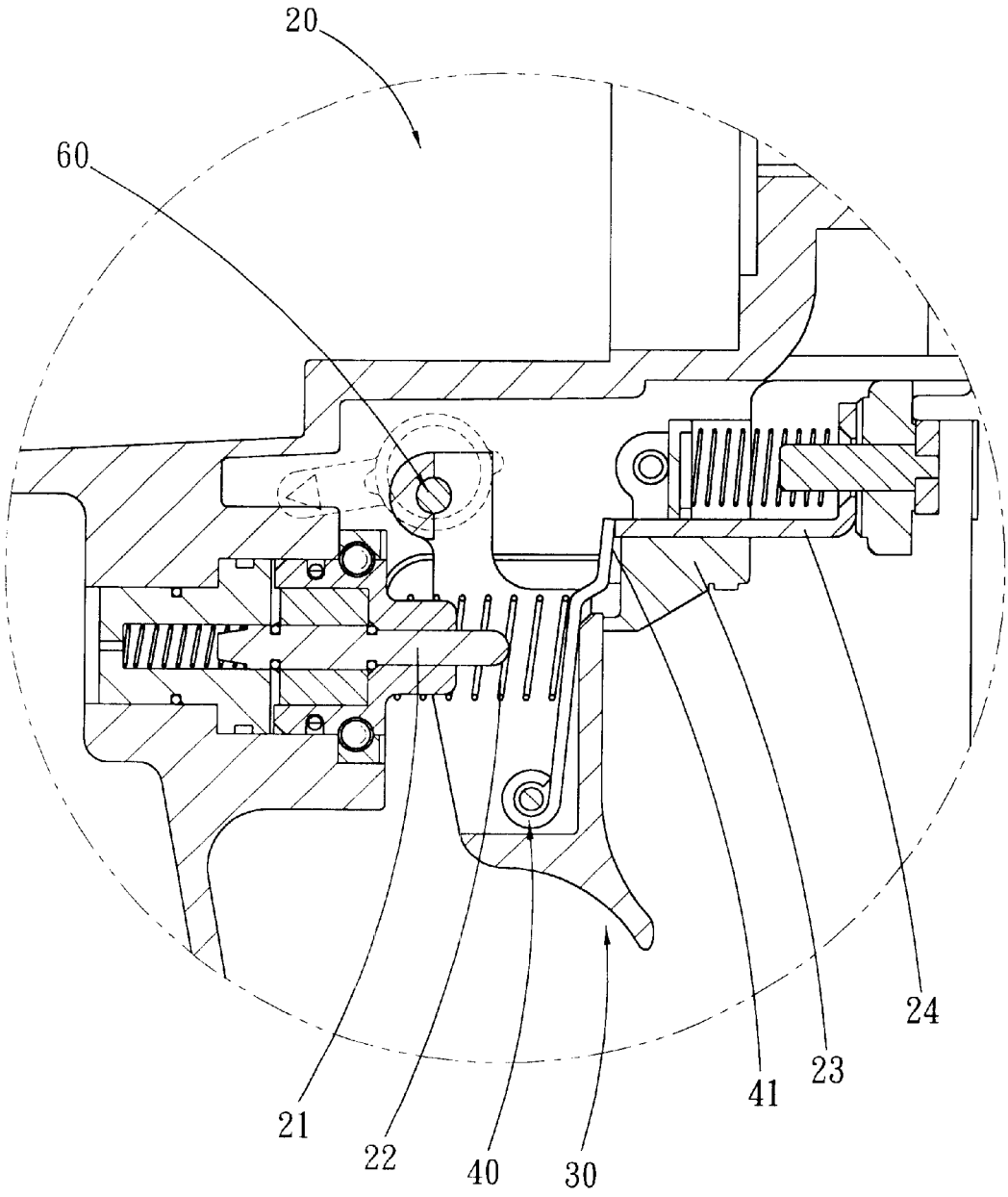
FIG. 5 shows the trigger and the activation plate are lowered.
Figure 6:
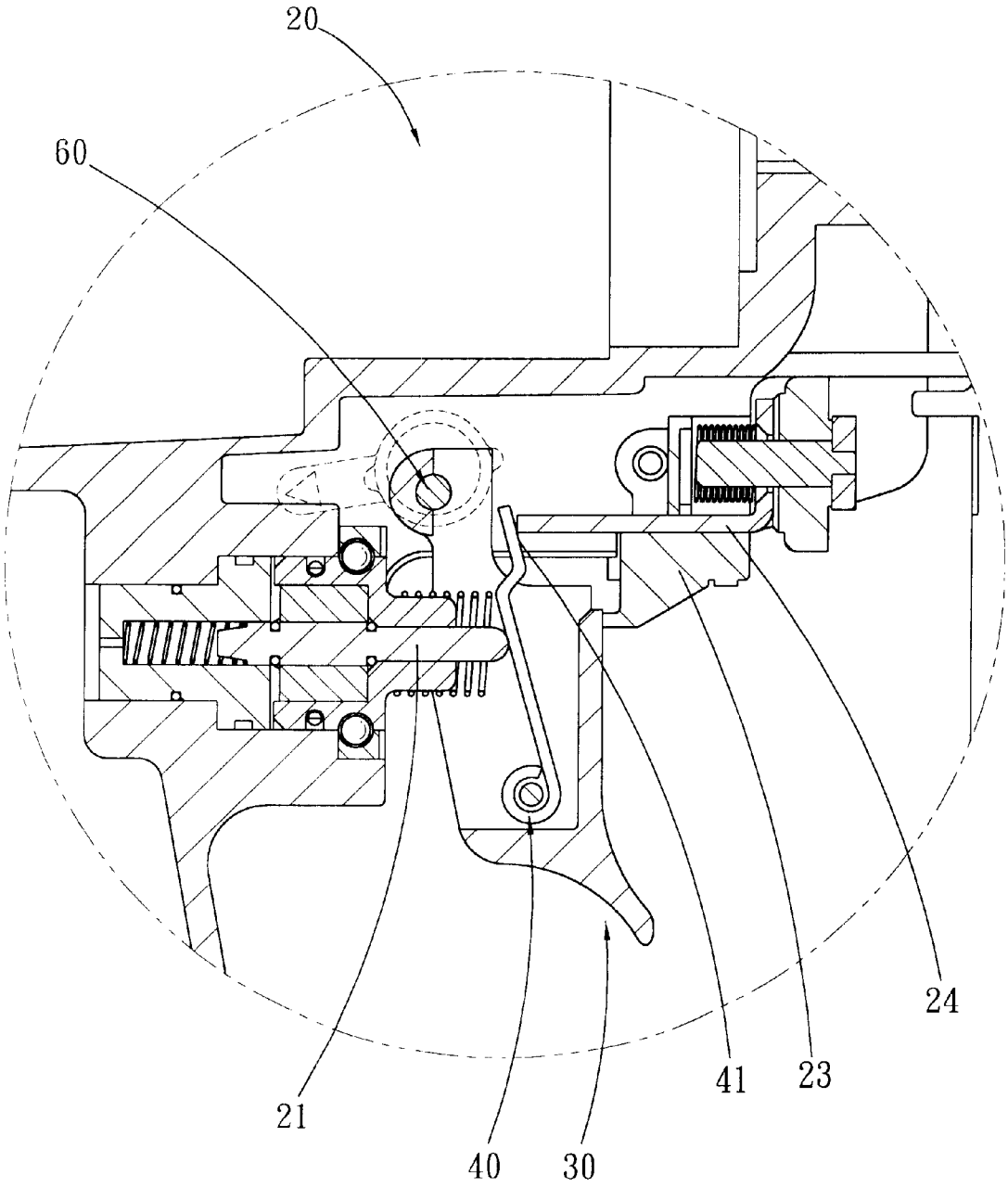
FIG. 6 shows the activation plate is pushed by the safety plate.
Figure 7:
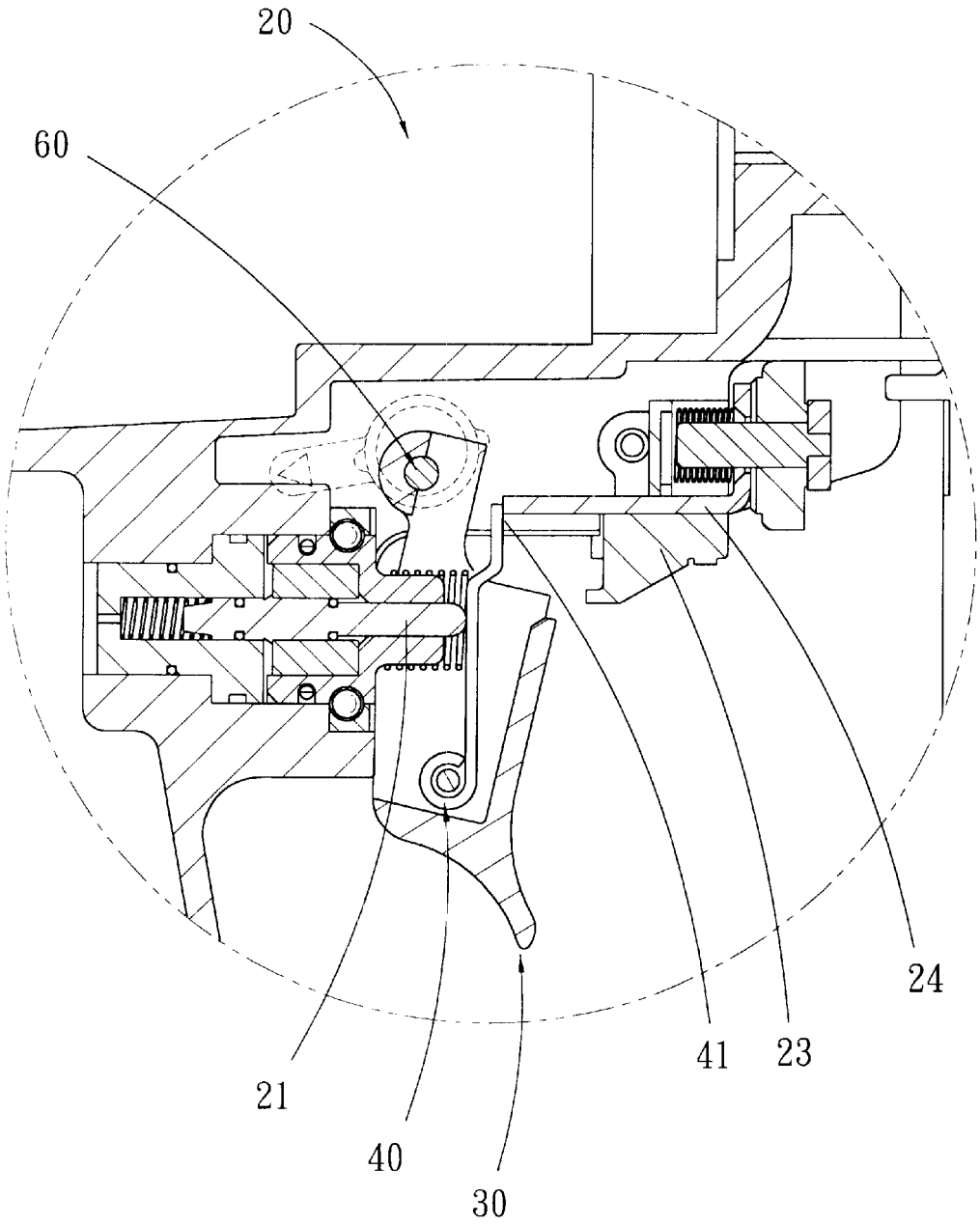
FIG. 7 shows the trigger is pulled.
Figure 8:
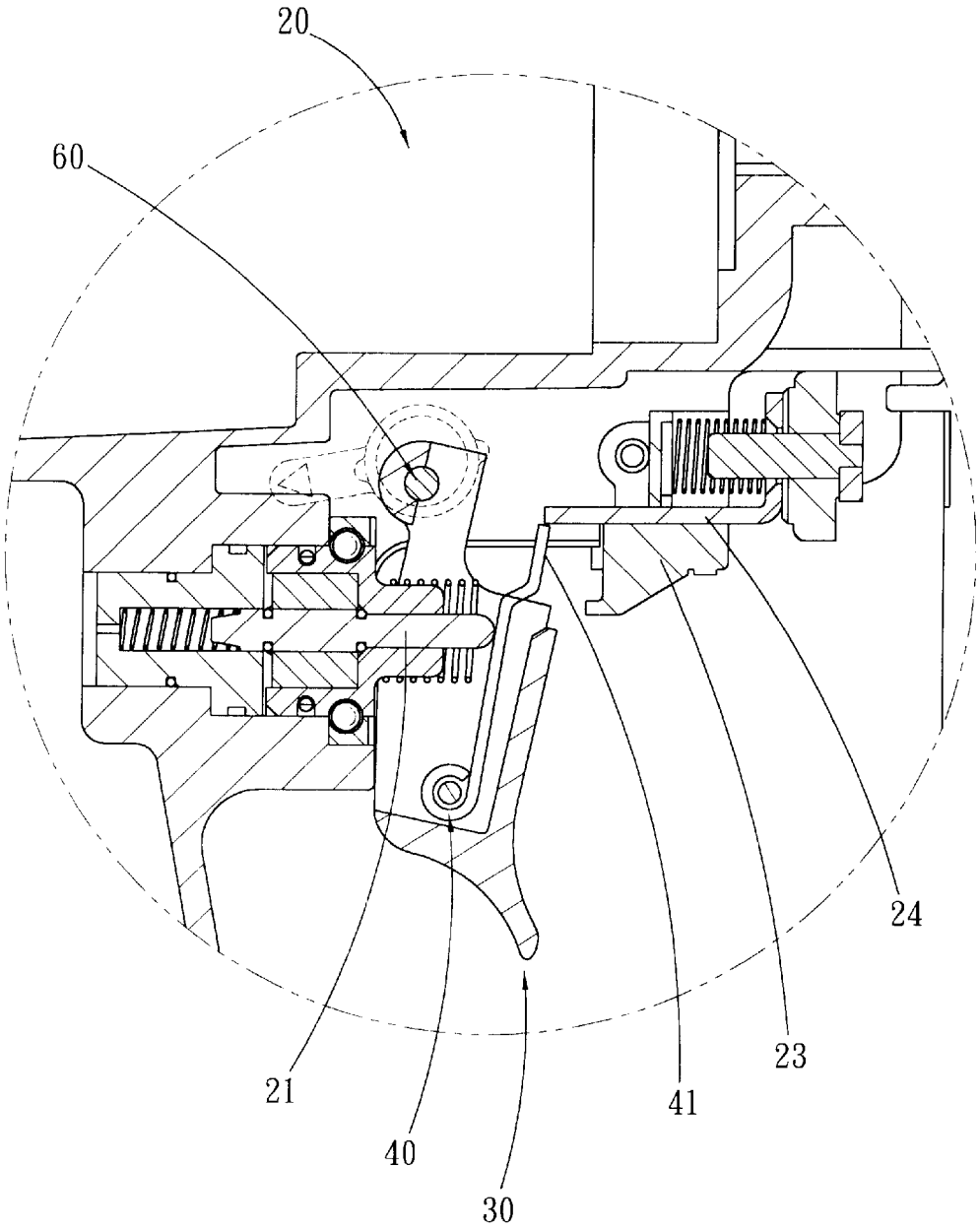
FIG. 8 shows the activation plate is not pushed by the safety plate after the trigger is pulled.

Referring to FIGS. 3 and 4, the trigger assembly of the present invention comprises a trigger 30 having a chamber 31 defined between two side walls and a tube with a passage 32 is located at a first end of the trigger 30. Two positioning holes 33 are defined through two the side walls of the trigger 30.

An activation plate 40 has a contact portion 41 on a first end of the activation plate 40 and a through hole 42 is defined in a second end of the activation plate 40. The activation plate 40 is received in the chamber 31 of the trigger 30 and a pin 34 extends through positioning holes 33 of the trigger 30 and the through hole 42 of the activation plate 40.

An adjusting member 50 has a lever 51 extending from a periphery thereof and a lug 52 on an end of the adjusting member 50. The adjusting member 50 is received in a hole 25 defined through the body 20 of the staple gun. Two positioning notches 26 are defined in an inner periphery of the hole 25. The lug 52 is engaged with one of the two positioning notches 26. An eccentric hole 53 is defined through the adjusting member 50 and a pin hole 54 is defined through the periphery of the adjusting member 50.

A cam rod 60 extends from a board 62 and a spring 63 is mounted onto the eccentric section 61 of the cam rod 60. The cam rod 60 extends through the hole 25 in the body 20 of the staple gun and the passage 32 of the trigger 30. A distal end of the cam rod 60 extends through the eccentric hole 53 of the adjusting member 50. A recess 64 is defined in the distal end of the cam rod 60 so that a pin 65 extends through the pin hole 54 in the adjusting member 50 and is engaged with the recess 64 in the cam rod 60.

A safety plate 24 extends through a positioning member 23 which is connected to the body 20 of the staple gun and a distal end of the safety plate 24 located in the chamber 31 of the trigger 30. A valve 21 is located beside the activation plate 40 and the trigger 30, and a spring 22 is mounted on an activation pin of the valve 21.

Referring to FIGS. 5 to 8, when the adjusting member 50 is positioned at the single shooting position, the rotation of the eccentric section 61 of the cam rod 60 lowers the trigger 30 and the activation plate 40. When the safety plate 24 is pushed, the distal end of the safety plate 24 pushes against the contact portion 41. When the trigger 30 is pulled, the activation plate 40 is also moved to activate the activation pin 21 of the valve to shoot a staple. The contact portion 41 is lowered after the trigger 30 is pulled so that the safety plate 24 cannot push the contact portion 41 again. This allows the staple gun to be shoot one shot a time.

Figure 9:
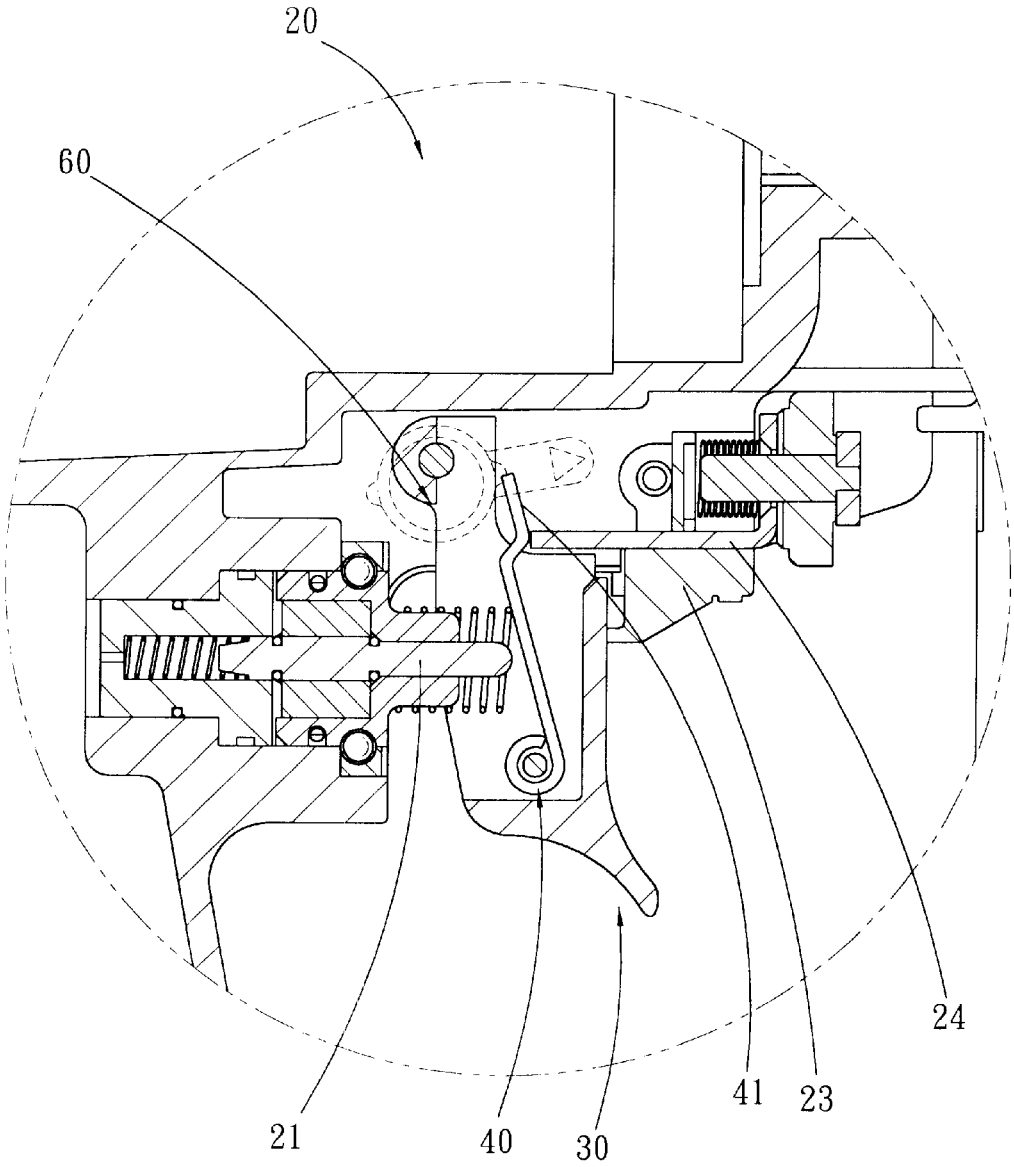
FIG. 9 shows the activation plate is lifted.
Figure 10:
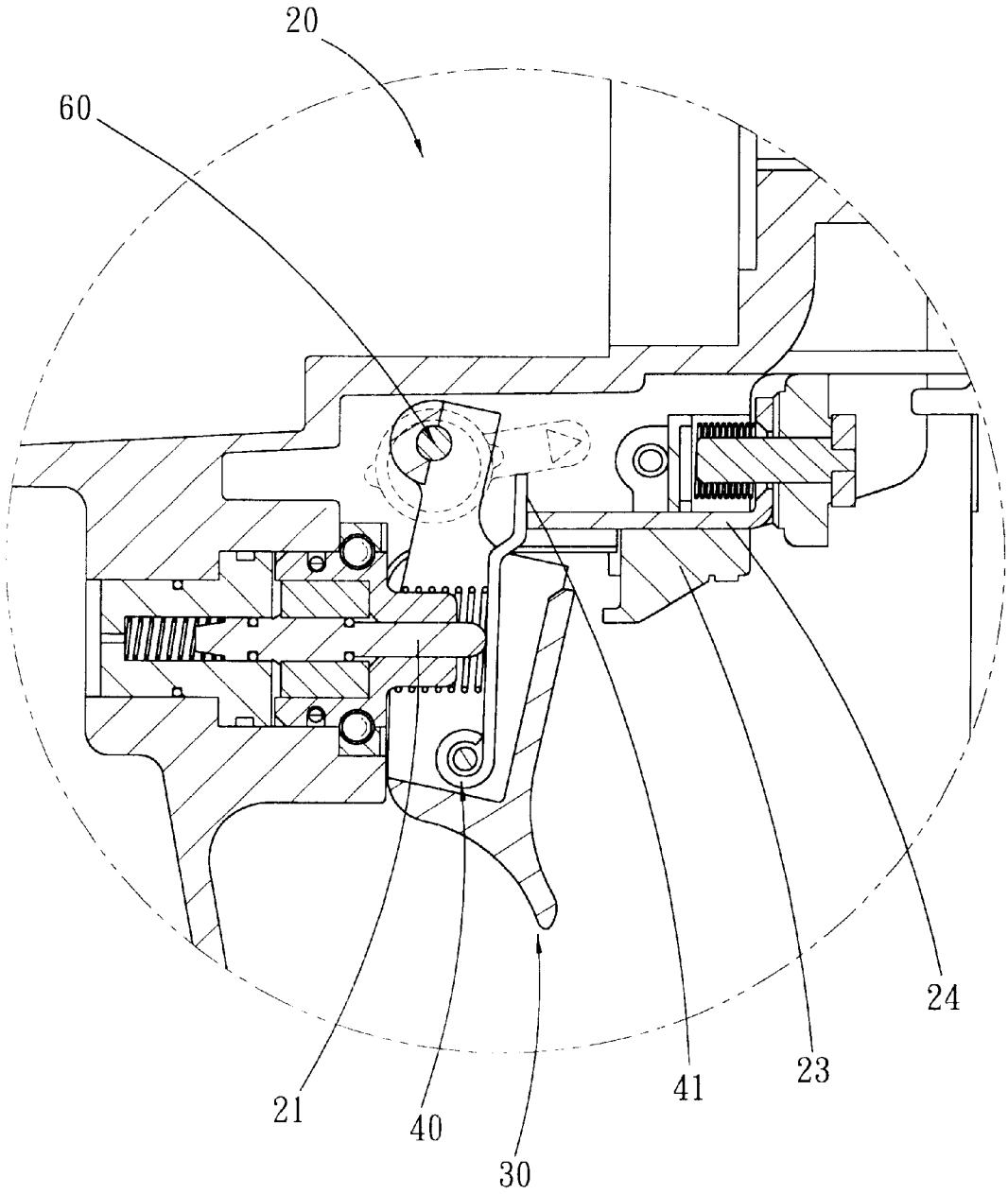
FIG. 10 shows the trigger is pulled.
Figure 11:
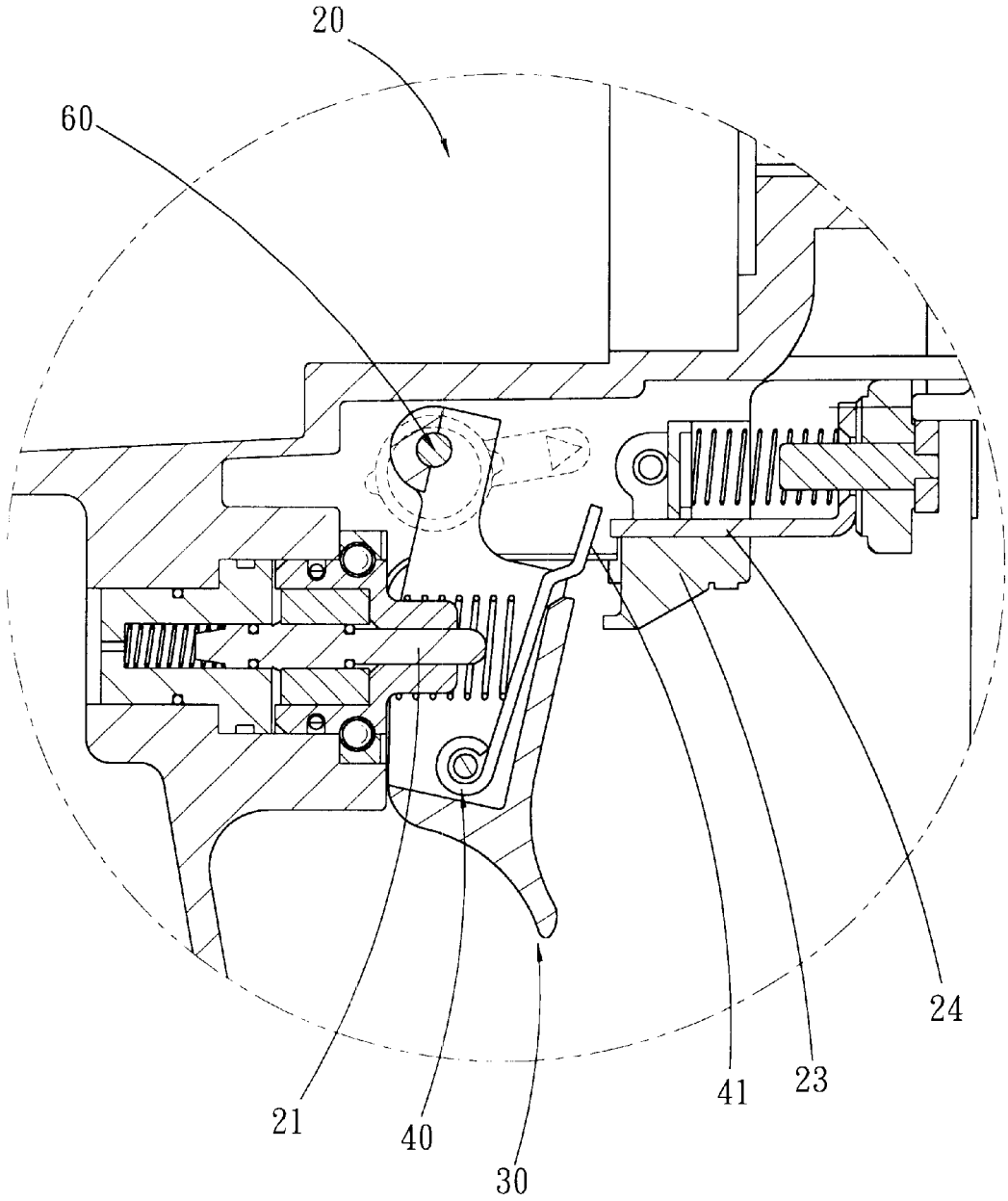
FIG. 11 shows the trigger is kept being pulled and the activation plate is ready for the next push by the safety plate.

Referring to FIGS. 9 to 11, the user may push the board 62 of the cam rod 60 to push the adjusting member 50 out from the hole 25 of the body 20 of the staple gun and the rotate the adjusting member 50 to let the lug 52 be engaged with the other positioning notch 26. The trigger 30 and the activation plate 40 are then lifted and the body of the activation plate 40 is moved close to the activation pin 21 of the valve when the safety plate 24 is pushed against the object.

When pulling the trigger 30, the staple is ejected and if the trigger is kept being pulled as shown in FIG. 10, the distal end of the safety plate 24 is still located at the position corresponding to the contact portion 41. Therefore, when the user pushes the safety plate 24 again, the activation plate 40 is pushed by the safety plate 24 again to activate the valve so that the staple gun can shoot again. In other words, the user simply holds the trigger and pushes the safety plate 24 against the objects, the staple gun shoots without re-operating the trigger 30 again and again.

While we have shown and described the embodiment in accordance with the present invention, it should be clear to those skilled in the art that further embodiments may be made without departing from the scope of the present invention.

What is claimed is:

1. A combination of a body of a staple gun and a trigger assembly, the body of the staple gun comprising a hole defined therethrough and two positioning notches defined in an inner periphery of the hole;

a trigger having a chamber defined therein and; a passage located at a first end of the trigger, two positioning holes defined through two side walls of the trigger;

an activation plate having a contact portion on a first end of the activation plate and a through hole defined in a second end of the activation plate, the activation plate received in the chamber of the trigger and a pin extending through positioning holes of the trigger and the through hole of the activation plate;

an adjusting member having a lever extending from a periphery thereof and a lug on an end of the adjusting member, the lug engaged with one of the two positioning notches, an eccentric hole defined through the adjusting member and a pin hole defined through the periphery of the adjusting member, and a cam rod extending from a board and a spring mounted onto the cam rod, the cam rod extending through the hole in the body of the staple gun and the passage of the trigger, a distal end of the cam rod extending through the eccentric hole of the adjusting member, a recess defined in the distal end of the cam rod so that a pin extends through the pin hole in the adjusting member and is engaged with the recess in the cam rod.

* * * * *